US005393488A

United States Patent [19]

Rhoads et al.

[11] Patent Number: 5,393,488

[45] Date of Patent: Feb. 28, 1995

[54] HIGH STRENGTH, HIGH FATIGUE STRUCTURAL STEEL

[75] Inventors: Mark A. Rhoads, Cincinnati; Edward L. Raymond, Maineville, both of Ohio; Warren M. Garrison, Jr., Pittsburgh, Pa.

[73] Assignee: General Electric Company, Cincinnati, Ohio

[21] Appl. No.: 102,923

[22] Filed: Aug. 6, 1993

[51] Int. Cl.[6] ..... C22C 38/52

[52] U.S. Cl. ..... 420/95; 420/107; 148/335

[58] Field of Search ..... 148/335, 328; 420/95, 420/107

[56] References Cited

U.S. PATENT DOCUMENTS 4,832,909 5/1989 Schmidt et al. ..... 420/95
5,087,415 2/1992 Hemphill et al. ..... 420/95

FOREIGN PATENT DOCUMENTS 48340192 5/1973 Japan ..... 420/95

OTHER PUBLICATIONS

Garrison et al.; A Preliminary Study of the Influence of Separate and Combined Aluminum and Nickel Additions on the Properties of a Secondary Hardening Steel; Metallurgical Transactions; vol. 19A (1988) pp. 3103–3107.

*Primary Examiner*—Deborah Yee
*Attorney, Agent, or Firm*—Jerome C. Squillaro; David L. Narciso

[57] ABSTRACT

A duplex strengthened structural steel that is particularly suitable for demanding applications which require both high yield strength and fatigue properties is provided. The preferred steel alloys of this invention are characterized by both the presence of intermetallic strengthening precipitates like maraging steels, as well as alloy carbide strengtheners as is common with secondary hardening steels. Titanium is substantially absent from the preferred steel alloys of this invention. Thus the formation of nonmetallic inclusions, such as titanium carbonitrides, are alleviated which correspondingly enhances the fatigue properties of the preferred alloys. To compensate for the lack of titanium strengthening precipitates within the alloy, additions of aluminum are provided such that the aluminum forms intermetallic strengthening precipitates with nickel.

16 Claims, No Drawings

HIGH STRENGTH, HIGH FATIGUE STRUCTURAL STEEL

Generally, the present invention relates to steels characterized by static yield strengths which exceed about 200 ksi. More particularly, this invention relates to such a type of steel which is modified so as to significantly enhance fatigue properties, by reducing the presence of titanium-base nonmetallic inclusions.

BACKGROUND OF THE INVENTION

Conventional low carbon maraging steels typically contain nickel, cobalt, molybdenum, and titanium, which cooperate to provide static yield strengths that generally range from about 150 to 300 ksi. In contrast to other steels, maraging steels are primarily hardened by the formation of intermetallic precipitates, such as $Ni_3Mo$ and $Ni_3Ti$. Such precipitates cause only very slight dimensional changes during hardening. In addition, maraging steels generally exhibit fracture toughness which is considerably better than that of most other high-strength steels. Consequently, maraging steels have been used in a variety of demanding applications which require relatively intricate shapes, such as fan shafts for turbine engines.

However, improvements in fatigue properties, such as fatigue strength, within maraging steels have been difficult to obtain and have typically resulted in reduced yield strength. Correspondingly, when enhanced yield strength has been sought, a reduction in fatigue properties has typically resulted. Thus, conventional maraging steel alloys generally offer either enhanced yield strength or fatigue properties, but not both. Such a result is unacceptable for demanding applications, particularly in the aerospace industry.

The fatigue life of maraging steels is dependent on crack initiation, which tend to occur at nonmetallic inclusions. Conventional maraging steels are particularly susceptible to brittle nonmetallic inclusions, such as carbides, oxides, sulfides, nitrides, carbonitrides, oxysulfides and carbosulfides, which are detrimental to strength, ductility and toughness. In the prior art, such inclusions have typically been minimized by clean melt practices Which serve to eliminate residual elements such as sulfur, oxygen, nitrogen and carbon. Other known practices employed to improve fatigue properties of maraging steels include shot peening and nitriding. Yet, existing maraging steels produced by such practices have attained relatively limited improvements in fatigue properties.

Secondary hardening steels have come into the forefront as a possible alternative to the use of maraging steels for the purpose of improving fatigue properties while retaining sufficient strength. However, to date, the desired combination of high strength coupled with adequate fatigue properties has not been achieved with the secondary hardening steels either. As with the maraging steels, it is the presence of the nonmetallic inclusions which detrimentally affect these properties.

Accordingly, it would be advantageous to provide a suitable structural steel which exhibits both enhanced yield strength and fatigue properties, and wherein nonmetallic inclusions which serve as fatigue initiation sites are substantially eliminated.

SUMMARY OF THE INVENTION

It is therefore an object of this invention to provide an improved structural steel alloy which exhibits both high yield strength and enhanced fatigue properties. It is a further object of this invention that such a steel achieve these improved properties by a "duplex" hardening mechanism, wherein alloy carbides common to secondary hardening type steels are formed upon exposure to appropriate aging temperatures, as well as intermetallic precipitates. It is yet a further object of this invention that the preferred structural steel be substantially free of titanium, so as to be characterized by the substantial absence of titanium-base nonmetallic inclusions such as titanium nitride and titanium carbonitride, thus promoting the fatigue properties of the preferred steel alloys.

According to the present invention, there is provided a family of duplex hardened structural steel alloys, wherein the preferred steels are hardened by the formation and presence of both intermetallic precipitates and alloy carbides upon exposure to appropriate aging temperatures. The preferred duplex hardened steels are characterized by both enhanced fatigue properties and relatively high yield strength.

The preferred steels of this invention are also generally characterized by the absence of titanium-base nonmetallic inclusions. It was determined in accordance with this invention, through the analysis of fatigue initiation sites within maraging steels, and particularly specimens which were subjected to torsional low cycle fatigue and axial-axial high cycle fatigue, that the presence of nonmetallic inclusions of titanium nitride (TiN) and titanium carbonitride (TiCN) at fatigue initiation sites were detrimental to fatigue properties of the maraging steels. Accordingly, an additional aspect of the present invention is directed to eliminating the precipitation of these offending nonmetallic inclusions within the preferred steel.

Titanium is a strong nitride and carbonitride former, thus the offending titanium-nitrogen nonmetallic inclusions tend to form even when conventionally acceptable low levels of nitrogen are present. However, titanium has generally always been used within maraging steels because of the formation of $Ni_3Ti$ strengthening precipitates. Therefore, the elimination of titanium has not been previously identified as a preferred means for improving the mechanical properties of such maraging steels, and particularly not as a means for improving the mechanical properties of the preferred duplex hardening steels of this invention, which are characterized by the presence of both alloy carbides common to secondary hardening type steels and intermetallic precipitates.

Thus, a significant advantage of the present invention is that the presence of offending titanium nitride and titanium carbonitride inclusions in the novel structural steel has been substantially reduced by formulating the preferred steel to be substantially free of titanium. The substantial absence of these inclusions significantly promotes the fatigue properties of the preferred structural steel alloys. However, to compensate for the corresponding reduction in the volume of desirable hardening $Ni_3Ti$ precipitates, such as found in conventional maraging steels, the present invention relies on the presence of aluminum and chromium in conjunction with suitable levels of nickel, cobalt, molybdenum, and carbon, to serve as strengthening elements. In particular, the aluminum and other elements are alloyed in combinations to form both intermetallic and alloy carbide precipitates within the novel duplex hardened steel.

As a result, structural steels produced in accordance with this invention are characterized by a combination of both high yield strength and fatigue properties, which can exceed that of conventional maraging steel alloys and secondary hardening steels. Furthermore, the preferred structural steels formed in accordance with this invention can be processed using conventional techniques, such as vacuum induction melting, vacuum arc remelting, electroslag remelting and electron beam melting. In addition, the preferred steel alloys are readily capable of being forged, solution annealed and age hardened to produce components which are suitable for numerous demanding applications.

DETAILED DESCRIPTION OF THE INVENTION

The present invention provides an improved structural steel, or more particularly, a variation of a low to medium carbon martensitic age hardened steel, which is suitable for demanding applications that require both high yield strength and good fatigue properties. The preferred steels of this invention are characterized by a duplex hardening mechanism, wherein the steels are hardened by the presence of both intermetallic precipitates and alloy carbides common to secondary hardening steels, after appropriate aging. The preferred steels are also characterized by the substantial absence of nonmetallic inclusions of titanium nitride and titanium carbonitride. By preventing the precipitation of these inclusions, improvements in strength and fatigue properties have been achieved which exceed that of previously known maraging and secondary hardening steels. In particular, the duplex hardened structural steel of this invention is characterized by yield strengths of at least about 200 ksi, and typically in excess of about 250 ksi. In addition, the preferred steel alloys offer a unique combination of high strength and high ductility.

The present invention is particularly directed to the use of maraging steels in applications in which structural components are subjected to torsional low cycle fatigue, and axial-axial low and high cycle fatigue, such as the fan shaft which couples the turbine to the fan of a turbine engine. With this invention, it has been determined that titanium-nitride and titanium carbonitride nonmetallic inclusions are a principle source for fatigue initiation sites, so as to be highly detrimental to the life of maraging steel components used in such applications.

As noted previously, the prior art has generally focused on the presence of nitrogen, oxygen, sulfur and carbon base nonmetallic inclusions, such as carbides, nitrides, oxides, sulfides, carbonitrides, oxysulfides and carbosulfides, with previous efforts seeking to minimize the presence of such nonmetallic inclusions through the elimination of impurities such as nitrogen, oxygen and sulfur from the melt through the practice of clean melt techniques. Correspondingly, the prior art has not sought to eliminate titanium from maraging steels, since titanium serves as a very strong precipitation hardener in conventional maraging steels, by the formation of $Ni_3Ti$ precipitates.

However, in accordance with the teachings of this invention, wherein titanium-nitride inclusions have been determined to serve as initiation sites for fatigue cracking, the presence of titanium is kept to a minimum within a novel age hardening steel alloy. Particularly low levels of titanium are necessary because titanium is a strong nitride and carbonitride former, even at low titanium contents with conventionally accepted levels of nitrogen. Yet, even without the intermetallic titanium precipitates, sufficient strength is achieved by a duplex hardening mechanism, wherein the preferred steels are hardened by the presence of both intermetallic precipitates and alloy carbides, after appropriate aging.

In accordance with a preferred embodiment of this invention, the preferred steel alloys are alloyed to be substantially titanium-free. Because most high strength maraging steels rely on the presence of titanium to form $Ni_3Ti$, the present invention compensates for the absence of titanium by including aluminum, as well as chromium which, in conjunction with suitable levels of nickel, cobalt, molybdenum, and carbon, serve as strengthening elements.

More specifically, a structural steel in accordance with this invention is characterized by a nominal chemical composition, in weight percents of about 10 to about 18% nickel, about 8 to about 16% cobalt, about 1 to about 5% molybdenum, about 0.5 to about 1.3% aluminum, about 1 to about 3% chromium, up to about 0.3% carbon, and less than about 0.10% titanium, with the balance essentially iron. The term "balance essentially iron" is used to include, in addition to iron in the balance of the alloy, small amounts of impurities and incidental elements, which in character and/or amount do not adversley affect the advantageous aspects of the alloy. This alloy may contain certain normal levels of impurities, such as up to about 30 ppm each of nitrogen, oxygen and sulfur. Unless otherwise specified herein, all compositions are given in weight percent.

Most notably, the preferred steel of this invention is substantially titanium-free, i.e., less than about 0.10% which may be due to normal steelmaking processes. As a result, the formation of the undesirable titanium nitride and titanium carbonitride precipitates is substantially prevented, such that the fatigue properties of the preferred steel are significantly enhanced.

The absence of titanium also prevents the formation of the highly desirable $Ni_3Ti$ hardening precipitates. However, as will be discussed in greater detail below, alloying additions of aluminum and chromium are included in the preferred steel alloys of this invention to sufficiently compensate for the lack of this intermetallic precipitate.

The carbon level of the preferred steel alloys preferably varies up to about 0.3%, and preferably in the range from about 0.15–0.25% and most preferably from about 0.18–0.22%. Conventionally, carbon is present in maraging steels in levels which do not exceed about 0.03%, because carbon is considered an impurity in maraging steels that forms undesirable titanium carbides which embrittle the alloy and are detrimental to strength, ductility and toughness. However, contrary to conventional maraging steels, the preferred steel alloys of this invention rely on the formation of chromium-molybdenum (Cr-Mo) carbides as a principle strengthener after aging, as is more common with secondary hardening steels. Accordingly, the relatively high level of carbon, up to about 0.3%, appears to optimize the formation of strengthening carbides within the preferred alloys.

As is conventional, the presence of nickel in the preferred steel alloys form the iron-nickel lath martensite, which generally improves the ductile-to-brittle transition temperature of the steel, and is available for intermetallic formation.

The preferred steel alloys of this invention have a molybdenum content of about 1% to about 5%. Molybdenum serves as a major hardener within the preferred steels, by providing both sources of hardening for the preferred duplex hardened steels of this invention, including fine $Ni_3Mo$ intermetallic precipitates and/or Cr-Mo carbides. Both the intermetallic precipitates and alloy carbides are uniformly dispersed throughout the alloys, after aging.

Cobalt does not directly contribute to the age hardening reaction of the preferred duplex hardened steel alloys, but is present in an amount from about 8% to about 16%, so as to lower the solubility of molybdenum in the steel and thus enhance strengthening by the formation of $Ni_3Mo$ and alloy carbides. The presence of cobalt also serves to raise the martensite transformation temperature ($M_s$) so as to compensate for other alloying elements, such as molybdenum, which tend to lower the martensite transformation temperature.

The remaining alloying elements of the preferred steels of this invention, namely, aluminum and chromium, are preferably present in combinations which will achieve duplex strengthening through the formation of aluminum-base intermetallic precipitates along with a fine dispersion of carbides. Most notably, it is believed that the 0.5 to about 1.3% aluminum forms intermetallic precipitates, such as NiAl and possibly $Ni_3Al$ as well as others, with at least a portion of the nickel so as to increase the yield strength of the alloy, and chromium and carbon are utilized for carbide formation, such as the Cr-Mo carbides. Chromium also enhances the corrosion resistance of the preferred alloy.

In accordance with the above, the nominal composition of the novel maraging steel of this invention has been refined to several preferred alloying embodiments, as provided below in Table I. The values provided are nominal weight percentages.

TABLE I

| Alloy | Ni | Co | Mo | Al | C | Cr | Nb, V, W | Ti |
|---|---|---|---|---|---|---|---|---|
| A | 16 | 14 | 2 | 1.25 | 0.1 | 2 | <0.01 | <0.10 |
| B | 16 | 14 | 5 | 1.25 | 0.1 | 2 | <0.01 | <0.10 |
| C | 10 | 14 | 1 | 0.80 | 0.2 | 2 | <0.01 | <0.10 |

Each of the above preferred alloys may be processed by substantially conventional methods. To promote purity of the alloys, the alloys are produced by vacuum induction melting (VIM), followed by one or more of the following remelt practices: vacuum arc remelting (VAR), electroslag remelting (ESR), or electron beam remelting (EBR). Ingots formed from the alloys are preferably homogenized at a temperature of about 2100° F. to about 2350° F. for a duration of about 24 to about 72 hours, and then air cooled. Further forming operations to produce forgings, plates, sheet and bar stock may then be performed, as is conventional. The above preferred alloys are then solution annealed by heating to about 1650° F. for one hour, and then air cooling. A further reheat to about 1550° F. for about one hour, followed by oil quenching, is believed to be optional. Age hardening is preferably conducted at a temperature of about 850° F. to about 950° F. for about 5 hours, followed by air cooling.

Generally, the preferred alloys exhibit hardness in the low to mid-30's on the Rockwell C scale ($HR_c$) after solution heat treatment, and exhibit hardness in the upper-40's to the upper-50's $HR_c$ after age hardening. Average room temperature tensile properties determined for standard smooth bar specimens of the preferred alloys are summarized below for given age hardening temperatures ($T_{AH}$).

TABLE II

| Alloy | $T_{AH}$ (°F.) | UTS (ksi) | Yield (ksi) | Elongation (percent) | Area Reduction (percent) |
|---|---|---|---|---|---|
| A | 890 | 308 | 285 | 11 | 50 |
| A | 950 | 284 | 277 | 13 | 53 |
| B | 850 | 327 | 307 | 7 | 25 |
| B | 950 | 303 | 288 | 9 | 37 |
| C | 950 | 312 | 280 | 15 | 60 |

High cycle fatigue tests were successfully conducted at a cycle rate of about 60 Hz and at an ambient temperature of about 400° F. on specimens of Alloys A and C. The age hardening temperature ($T_{AH}$) for Alloy A was about 850° F., and for Alloy C about 950° F. Specimens of each alloy where cycled at stress levels (axial, alternating sinusoidal) of either about 38 or about 71 ksi, and at amplitudes corresponding to an A-ratio of either about 0.15 or about 0.5 (A-ratio being the ratio of the alternating stress to the mean stress in the specimen). Results indicated an increase in load carrying capacity of about 12 to about 15 percent over conventional maraging steel alloys, such as MAR 250 also designated as 18-Ni 8-Co 5 Mo 0.45-Ti.

Torsional low cycle fatigue tests were also successfully conducted at a cycle rate of about 1 Hz and at an ambient temperature of about 400° F. on specimens of Alloys A and C. The age hardening temperatures ($T_{AH}$) were the same as that for the above high cycle fatigue tests. Specimens of each alloy where cycled at shear stress levels (alternating sinusoidal). of about 79.5 ksi, and at an amplitude corresponding to an A-ratio of about 1.0. Results indicated an increase in load carrying capacity of at least about 15 percent over conventional maraging steel alloys, such as such as MAR 250 also designated as 18-Ni 8-Co 5 Mo 0.45-Ti.

From the above, it is apparent that the preferred duplex hardened steel alloys of this invention are characterized by a combination of yield strength and fatigue properties which exceeds that of conventional maraging and/or secondary hardening steel alloys. This is achieved within the preferred alloys, principally, by formation of intermetallic strengthening precipitates, such as by the addition of the aluminum which forms the aluminum-base intermetallic precipitates, NiAl and/or $NiAl_3$, in conjunction with the formation of suitable carbides, while eliminating the presence of titanium and correspondingly the formation of detrimental titanium carbonitrides within the alloy which served to reduce the fatigue life of these types of alloys.

In addition, the preferred duplex hardened steel alloys of this invention-can be readily forged, solution annealed and age hardened to produce articles which are suitable for numerous applications, such as fan shafts for turbine engines. Finally, each of the above advantages can be achieved utilizing processing techniques which are known in the art, such as vacuum induction melting and vacuum arc remelting.

While our invention has been described in terms of a preferred embodiment, it is apparent that other forms could be adopted by one skilled in the art. Therefore, the scope of our invention is to be limited only by the following claims. The embodiments of the invention in which an exclusive property or privilege is claimed are defined as follows:

We claim:

1. A high strength, fatigue-resistant steel alloy which is substantially free of titanium nitride and titanium carbonitride precipitates, the steel alloy comprising:
about 10 to about 18 weight percent nickel;
about 8 to about 16 weight percent cobalt;
about 1 to about 5 weight percent molybdenum;
about 0.5 to about 1.3 weight percent aluminum;
about 1 to about 3 weight percent chromium;
up to about 0.3 weight percent carbon;
less than about 0.10 weight percent titanium; and
the balance being essentially iron with trace amounts of ordinarily present elements;
whereby the presence of molybdenum, aluminum, chromium, and carbon within the steel alloy provide duplex strengthening through the formation of a fine dispersion of intermetallic precipitates and carbides so as to enhance the yield strength of the steel alloy, and whereby the fatigue properties of the steel alloy are enhanced by the substantial absence of titanium within the steel alloy which precludes the formation of the titanium nitride and titanium carbonitride precipitates within the steel alloy.

2. The high strength, fatigue resistant steel alloy of claim 1 wherein the steel alloy is characterized by a uniform dispersion of aluminum-base intermetallic precipitates.

3. The high strength, fatigue resistant steel alloy of claim 1 wherein the steel alloy is characterized by the presence of chromium-molybdenum carbides.

4. The high strength, fatigue resistant steel alloy of claim 1 wherein the steel alloy is duplex strengthened by aluminum-base intermetallic precipitates and a fine dispersion of chromium-molybdenum carbides.

5. The high strength, fatigue resistant steel alloy of claim 1 wherein the steel alloy is characterized by a yield strength of at least about 200 ksi.

6. A high strength, fatigue-resistant steel alloy which is substantially free of titanium nitride and titanium carbonitride precipitates, the steel alloy consisting essentially of:
about 10 to about 18 weight percent nickel;
about 8 to about 16 weight percent cobalt;
about 1 to about 5 weight percent molybdenum;
about 0.5 to about 1.3 weight percent aluminum, at least a portion of the aluminum forming intermetallic precipitates with at least a portion of the nickel;
about 1 to about 3 weight percent chromium;
about 0.15 to about 0.25 weight percent carbon, at least a portion of the carbon forming uniformly dispersed carbides with at least a portion of the molybdenum and at least a portion of the chromium;
less than about 0.10 weight percent titanium; and
the balance being essentially iron with trace amounts of ordinarily present elements, including niobium, vanadium and tungsten;
whereby the combination of the intermetallic precipitates formed by the aluminum, and the carbides formed by the carbon, chromium and molybdenum within the steel alloy provide enhanced yield strength of the steel alloy, and whereby the fatigue properties of the steel alloy are enhanced by the substantial absence of titanium which substantially precludes the formation of titanium nitride and titanium carbonitride precipitates within the steel alloy.

7. The high strength, fatigue resistant steel alloy of claim 6 wherein the steel alloy is strengthened by at least a portion of the molybdenum forming intermetallic precipitates with at least a portion of the nickel.

8. The high strength, fatigue resistant steel alloy of claim 6 wherein the uniformly dispersed carbides formed by the carbon, molybdenum and chromium are substantially a chromium-molybdenum carbide.

9. The high strength, fatigue resistant steel alloy of claim 6 wherein the steel alloy is characterized by a yield strength of at least about 250 ksi.

10. The high strength, fatigue resistant steel alloy of claim 6 wherein the niobium, vanadium and tungsten together constitute less than about 0.01 weight percent of the steel alloy.

11. A high strength, fatigue-resistant article formed from a steel alloy which is substantially free of titanium nitride and titanium carbonitride precipitates, the steel alloy comprising:
about 10 to about 18 weight percent nickel;
about 8 to about 16 weight percent cobalt;
about 1 to about 5 weight percent molybdenum;
about 0.5 to about 1.3 weight percent aluminum;
about 1 to about 3 weight percent chromium;
up to about 0.3 weight percent carbon;
less than about 0.10 weight percent titanium; and
the balance being essentially iron with trace amounts of ordinarily present elements;
whereby the substantial absence of titanium within the steel alloy enhances the fatigue properties of the article by substantially precluding the formation of titanium nitride and titanium carbonitride precipitates within the article, and whereby the presence of aluminum, chromium, and molybdenum within the steel alloy provide duplex strengthening of the article through the formation of intermetallic precipitates and a fine dispersion of carbides.

12. The article of claim 11 wherein the steel alloy consists essentially of:
about 10 to about 18 weight percent nickel;
about 8 to about 16 weight percent cobalt;
about 1 to about 5 weight percent molybdenum;
about 0.5 to about 1.3 weight percent aluminum;
about 1 to about 3 weight percent chromium;
about 0.15 to about 0.25 weight percent carbon;
less than about 0.10 weight percent titanium; and
the balance being essentially iron with trace amounts of ordinarily present elements, including niobium, vanadium and tungsten.

13. The article of claim 11 wherein at least a portion of the aluminum forms intermetallic precipitates with at least a portion of the nickel.

14. The article of claim 11 wherein at least a portion of the carbon forms a uniformly dispersed carbide with at least a portion of the molybdenum and at least a portion of the chromium.

15. The article of claim 11 wherein the uniformly dispersed carbides are substantially chromium-molybdenum carbides.

16. The article of claim 11 wherein the steel alloy is characterized by a yield strength of at least about 250 ksi.

* * * * *